US012038178B2

(12) United States Patent
Shin et al.

(10) Patent No.: US 12,038,178 B2
(45) Date of Patent: Jul. 16, 2024

(54) MICRO-MIXER WITH MULTI-STAGE FUEL SUPPLY AND GAS TURBINE INCLUDING SAME

(71) Applicant: DOOSAN ENERBILITY CO., LTD., Changwon (KR)

(72) Inventors: Young Jun Shin, Seongnam (KR); Han Jin Jeong, Hanam (KR); Eun Seong Cho, Busan (KR)

(73) Assignee: DOOSAN ENERBILITY CO., LTD., Changwon (KR)

( * ) Notice: Subject to any disclaimer, the term of this patent is extended or adjusted under 35 U.S.C. 154(b) by 0 days.

(21) Appl. No.: 18/163,361

(22) Filed: Feb. 2, 2023

(65) Prior Publication Data

US 2023/0250959 A1 Aug. 10, 2023

(30) Foreign Application Priority Data

Feb. 7, 2022 (KR) ..... 10-2022-0015719

(51) Int. Cl.

| | |
|---|---|
| ***F23D 14/64*** | (2006.01) |
| ***F23R 3/28*** | (2006.01) |
| ***F23R 3/32*** | (2006.01) |
| ***F23R 3/34*** | (2006.01) |

(52) U.S. Cl.

CPC ..... *F23R 3/286* (2013.01); *F23D 14/64* (2013.01); *F23R 3/32* (2013.01); *F23R 3/346* (2013.01)

(58) Field of Classification Search

CPC ..... F23D 14/62; F23D 14/64; F23R 3/32
USPC ..... 431/157, 169, 354; 110/277
See application file for complete search history.

(56) References Cited

U.S. PATENT DOCUMENTS 3,170,504 A * 2/1965 Lanning ..... F23D 14/145 126/92 R
3,954,387 A * 5/1976 Cooper ..... F24C 15/24 431/328
4,063,873 A * 12/1977 Naito ..... F23D 14/145 431/328
4,100,733 A * 7/1978 Striebel ..... F23R 3/286 239/431
4,504,218 A * 3/1985 Mihara ..... C04B 35/6263 431/328
4,805,588 A * 2/1989 Reynolds ..... A47J 37/0682 126/41 A
5,997,285 A * 12/1999 Carbone ..... F23D 14/02 431/354

(Continued)

FOREIGN PATENT DOCUMENTS

JP 2002-257344 A 9/2002
JP 2013-104653 A 5/2013

(Continued)

OTHER PUBLICATIONS

EP EESR, dated Jun. 16, 2023.

*Primary Examiner* — Todd E Manahan
*Assistant Examiner* — Marc J Amar
(74) *Attorney, Agent, or Firm* — Harvest IP Law, LLP

(57) ABSTRACT

A micro-mixer includes a plurality of fuel tubes through which air and fuel flow, a casing accommodating the plurality of fuel tubes therein, an injection part formed as a pyramidal protrusion on one side of the casing and connected to a front end of the fuel tube to inject the air and the fuel, and a fuel supply divided into a plurality of fuel supply parts to supply the fuel to the fuel tubes.

18 Claims, 11 Drawing Sheets

(56) References Cited

U.S. PATENT DOCUMENTS

| | | | | |
|---|---|---|---|---|
| 8,112,999 | B2 | 2/2012 | Zuo | |
| 8,943,832 | B2 | 2/2015 | Uhm | |
| 9,353,950 | B2 | 5/2016 | Uhm | |
| 9,759,425 | B2 | 9/2017 | Westmoreland | |
| 2010/0050640 | A1* | 3/2010 | Belsom | F23R 3/002 60/734 |
| 2011/0083439 | A1* | 4/2011 | Zuo | F23R 3/36 60/737 |
| 2011/0185703 | A1 | 8/2011 | Dodo | |
| 2012/0006030 | A1 | 1/2012 | Uhm | |
| 2013/0074510 | A1 | 3/2013 | Berry | |
| 2013/0084534 | A1* | 4/2013 | Melton | F23R 3/46 431/2 |
| 2013/0213051 | A1* | 8/2013 | Westmoreland, III | F23R 3/286 60/776 |
| 2013/0318975 | A1 | 12/2013 | Stoia | |
| 2014/0109582 | A1 | 4/2014 | Shershnyov | |
| 2014/0157779 | A1 | 6/2014 | Uhm | |
| 2014/0283522 | A1* | 9/2014 | Boardman | F23R 3/286 60/737 |
| 2015/0113998 | A1* | 4/2015 | Tatsumi | F23N 5/18 60/776 |
| 2016/0033133 | A1 | 2/2016 | Johnson | |
| 2017/0089583 | A1 | 3/2017 | Simmons | |
| 2019/0170356 | A1 | 6/2019 | Cerutti | |
| 2020/0158020 | A1* | 5/2020 | Yagi | F23R 3/286 |
| 2021/0325046 | A1 | 10/2021 | Lin | |

FOREIGN PATENT DOCUMENTS

| | | | |
|---|---|---|---|
| JP | 2017172953 | A | 9/2017 |
| JP | 2020085284 | A | 6/2020 |
| JP | 2021055971 | A | 4/2021 |
| JP | 2021-169913 | A | 10/2021 |
| KR | 100778716 | B1 | 11/2007 |
| KR | 101749875 | A | 6/2017 |
| KR | 1020190122814 | A | 10/2019 |

* cited by examiner

MICRO-MIXER WITH MULTI-STAGE FUEL SUPPLY AND GAS TURBINE INCLUDING SAME

CROSS REFERENCE TO RELATED APPLICATION

The present application claims priority to Korean Patent Application No. 10-2022-0015719, filed on Feb. 7, 2022, the entire contents of which are incorporated herein for all purposes by this reference.

BACKGROUND OF THE INVENTION

1. Field of the Invention

The present disclosure relates to a micro-mixer with a multi-stage fuel supply, and a gas turbine including the same.

2. Description of the Background Art

A turbine is a machine that obtains rotational force with an impulsive force or reaction force using a flow of compressive fluids such as steam and gas, and such turbines include a steam turbine using steam, a gas turbine using high temperature combustion gas, or the like.

A gas turbine is a combustion engine in which a mixture of air compressed by a compressor and fuel is combusted to produce a high temperature gas, which drives a turbine. The gas turbine is used to drive electric generators, aircraft, ships, trains, or the like.

The gas turbine generally includes a compressor, a combustor, and a turbine. The compressor serves to intake external air, compress the air, and transfer the compressed air to the combustor. The compressed air compressed by the compressor has a high temperature and a high pressure. The combustor serves to mix compressed air from the compressor and fuel and combust the mixture of compressed air and fuel to produce combustion gases, which are discharged to the gas turbine. The combustion gases drive turbine blades in the turbine to produce power. The power generated through the above processes is applied to a variety of fields such as generation of electricity, driving of mechanical units, etc.

Fuel is injected through nozzles disposed in respective combustors, wherein the fuel includes gaseous fuel and liquid fuel. In recent years, in order to suppress the emission of carbon dioxide, use of hydrogen fuel or a fuel containing hydrogen is recommended.

In a gas turbine combustor, the temperature of flames or the degree of combustion vibration varies according to the mix of fuel and air. When the mix of fuel and air is high, the fuel concentration becomes uniform. At this time, when the combustion reaction occurs in a fuel-lean state, the flame temperature is lowered so that the amount of exhaust gases such as nitrogen oxides (NOx) can be reduced.

However, in this case, there is a problem in that unburned fuel or carbon monoxide (CO) is easily generated due to the low combustion temperature and the combustion vibration occurs due to unstable flames.

The foregoing is intended merely to aid in the understanding of the background of the present disclosure, and is not intended to mean that the present disclosure falls within the purview of the related art that is already known to those skilled in the art.

SUMMARY OF THE INVENTION

Accordingly, the present disclosure has been made keeping in mind the above problems occurring in the related art, and an objective of the present disclosure is to provide a micro-mixer with a multi-stage fuel supply in which a plurality of fuel supply parts is provided such that a supply of fuel is adjusted for each fuel supply part to enable an optimal operation for reducing combustion vibration and NOx, and a gas turbine including the same.

In an aspect of the present disclosure, there is provided a micro-mixer including: a plurality of fuel tubes through which air and fuel flow; a casing accommodating the plurality of fuel tubes therein, an injection part formed as a pyramidal protrusion on one side of the casing and connected to a front end of the fuel tube to inject the air and the fuel; and a fuel supply divided into a plurality of fuel supply parts to supply the fuel to the fuel tubes.

The fuel supply may include a first fuel supply part configured to inject the fuel into the fuel tubes located in a first region, and a second fuel supply part configured to inject the fuel into the fuel tubes located in a second region excluding the first region.

The first fuel supply part and the second fuel supply part may be disposed in a layered structure, and the first fuel supply part may be disposed closer to the injection part than the second fuel supply part.

The first region may be located at a central portion of the fuel tubes,

The second region may be located at a peripheral portion around the central portion of the fuel tubes.

The first fuel supply part and the second fuel supply part may independently control a supply of fuel.

The first fuel supply part may include: a first fuel container receiving the fuel through a first fuel supply hole; a first fuel inlet formed in the first fuel container; a first fuel distribution module connected to the first fuel inlet to distribute the fuel introduced through the first fuel inlet to the fuel tubes in the first region; and a first fuel injection module connecting the first fuel distribution module and the fuel tubes in the first region to inject the fuel to the fuel tubes.

The second fuel supply part may include: a second fuel container receiving the fuel through a second fuel supply hole; a second fuel inlet formed in the second fuel container; a second fuel distribution module connected to the second inlet to distribute the fuel introduced through the second fuel inlet to the fuel tubes in the second region; and a second fuel injection module connecting the second fuel distribution module and the fuel tubes in the second region to inject the fuel to the fuel tubes.

The first fuel distribution module and the second fuel distribution module may have the same distance to the closest fuel tubes thereto.

The fuel supply may further include a third fuel supply part configured to inject the fuel into the fuel tubes located in a third region.

The first region may be located at a central portion of the fuel tubes, the second region may be located at a peripheral portion around the central portion of the fuel tubes, and the third region may be located between the first region and the second region.

In another aspect of the present disclosure, there is provided a gas turbine including: a compressor configured to compress air introduced from the outside, a combustor having a micro-mixer and configured to mix the compressed air compressed in the compressor and fuel and combust an air-fuel mixture, and a turbine including a plurality of turbine blades to be rotated by combustion gases combusted in the combustor, the micro-mixer including: a plurality of fuel tubes through which the air and the fuel flow; a casing accommodating the plurality of fuel tubes therein, an injection part formed as a pyramidal protrusion on one side of the casing and connected to a front end of the fuel tube to inject the air and the fuel; and a fuel supply divided into a plurality of fuel supply parts to supply the fuel to the fuel tubes.

The fuel supply may include a first fuel supply part configured to inject the fuel into the fuel tubes located in a first region, and a second fuel supply part configured to inject the fuel into the fuel tubes located in a second region.

The first fuel supply part and the second fuel supply part may be disposed in a layered structure, and the first fuel supply part may be disposed closer to the injection part than the second fuel supply part.

The first region may be located at a central portion of the fuel tubes,

The second region may be located at a peripheral portion around the central portion of the fuel tubes.

The first fuel supply part and the second fuel supply part may independently control a supply of fuel.

The first fuel supply part may include: a first fuel container receiving the fuel through a first fuel supply hole; a first fuel inlet formed in the first fuel container; a first fuel distribution module connected to the first fuel inlet to distribute the fuel introduced through the first fuel inlet to the fuel tubes in the first region; and a first fuel injection module connecting the first fuel distribution module and the fuel tubes in the first region to inject the fuel to the fuel tubes.

The second fuel supply part may include: a second fuel container receiving the fuel through a second fuel supply hole; a second fuel inlet formed in the second fuel container; a second fuel distribution module connected to the second inlet to distribute the fuel introduced through the second fuel inlet to the fuel tubes in the second region; and a second fuel injection module connecting the second fuel distribution module and the fuel tubes in the second region to inject the fuel to the fuel tubes.

The first fuel distribution module and the second fuel distribution module may have the same distance to the closest fuel tubes thereto.

The fuel supply may further include a third fuel supply part configured to inject the fuel into the fuel tubes corresponding to a third region.

The first region may be located at a central portion of the fuel tubes, the second region may be located at a peripheral portion around the central portion of the fuel tubes, and the third region may be located between the first region and the second region.

As described above, according to the present disclosure, in the micro-mixer and the gas turbine, the plurality of fuel supply parts is provided such that a supply of fuel is adjusted for each fuel supply part to enable an optimal operation for reducing combustion vibration and NOx.

DETAILED DESCRIPTION OF THE INVENTION

Figure 1:
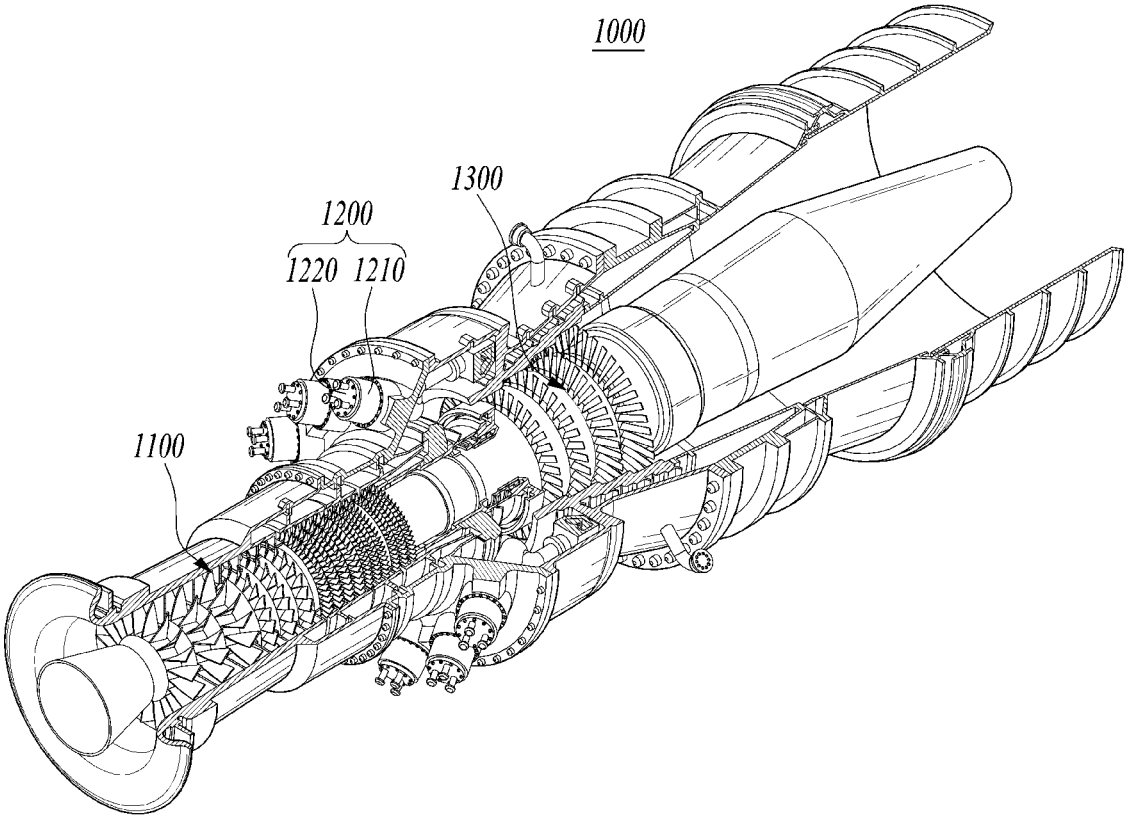
FIG. 1 is a view illustrating the interior of a gas turbine according to a first embodiment of the present disclosure.

Hereinafter, exemplary embodiments of the present disclosure will be described in detail with reference to the accompanying drawings. However, it should be noted that the present disclosure is not limited thereto, and may include all of modifications, equivalents or substitutions within the spirit and scope of the present disclosure.

Terms used herein are used to merely describe specific embodiments, and are not intended to limit the present disclosure. As used herein, an element expressed as a singular form includes a plurality of elements, unless the context clearly indicates otherwise. Further, it will be understood that the terms "comprising" or "including" specifies the presence of stated features, numbers, steps, operations, elements, parts, or combinations thereof, but does not preclude the presence or addition of one or more other features, numbers, steps, operations, elements, parts, or combinations thereof. Hereinafter, preferred embodiments of the present disclosure will be described in detail with reference to the accompanying drawings.

Hereinafter, preferred embodiments of the present disclosure will be described in detail with reference to the accompanying drawings. It is noted that like elements are denoted in the drawings by like reference symbols as whenever possible. Further, the detailed description of known functions and configurations that may obscure the gist of the present disclosure will be omitted. For the same reason, some of the elements in the drawings are exaggerated, omitted, or schematically illustrated.

Hereinafter, a gas turbine 1000 according to an embodiment of the present disclosure will be described.

Figure 2:
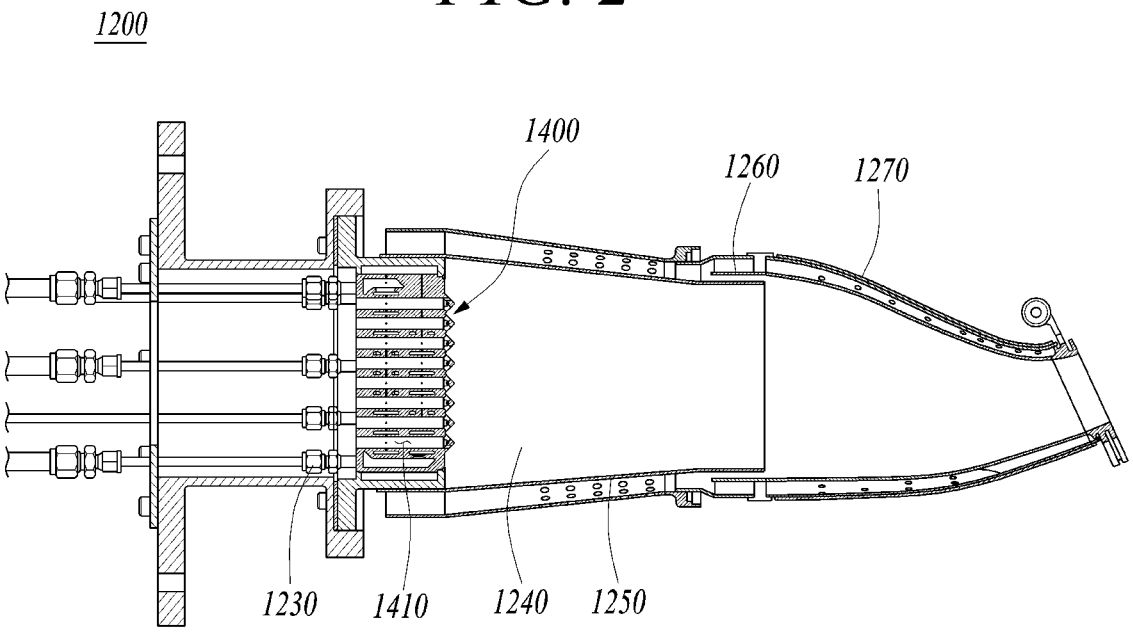
FIG. 2 is a longitudinal sectional view illustrating a combustor of FIG. 1.

FIG. 1 is a view illustrating the interior of a gas turbine according to an embodiment of the present disclosure, and FIG. 2 is a longitudinal sectional view illustrating a combustor of FIG. 1.

An ideal thermodynamic cycle of a gas turbine 1000 according to the present embodiment follows a Brayton cycle. The Brayton cycle consists of four thermodynamic processes: isentropic compression (adiabatic compression), isobaric combustion, isentropic expansion (adiabatic expansion) and isobaric heat ejection. That is, in the Brayton cycle, atmospheric air is sucked and compressed into high pressure air, mixed gas of fuel and compressed air is combusted at constant pressure to discharge heat energy, heat energy of hot expanded combustion gas is converted into kinetic energy, and exhaust gases containing remaining heat energy is discharged to the outside. That is, gases undergo four thermodynamic processes: compression, heating, expansion, and heat ejection.

As illustrated in FIG. 1, the gas turbine 1000 employing the Brayton cycle includes a compressor 1100, a combustor 1200, and a turbine 1300. Although the following description will be described with reference to FIG. 1, the present disclosure may be widely applied to other turbine engines similar to the gas turbine 1000 illustrated in FIG. 1.

Referring to FIGS. 1 and 2, the compressor 1100 of the gas turbine 1000 may suck and compress external air. The compressor 1100 may serve both to supply the compressed air by compressor blades to a combustor 1200 and to supply the cooling air to a high temperature region of the gas turbine 1000. Here, since the sucked air undergoes an adiabatic compression process in the compressor 1100, the air passing through the compressor 1100 has increased pressure and temperature.

The compressor 1100 is usually designed as a centrifugal compressor or an axial compressor, and the centrifugal compressor is applied to a small-scale gas turbine, whereas a multi-stage axial compressor 1100 is applied to a large-scale gas turbine 1000 illustrated in FIG. 1 since the large-scale gas turbine 1000 is required to compress a large amount of air.

The compressor 1100 is driven using a portion of the power output from the turbine 1300. To this end, as illustrated in FIG. 1, the rotary shaft of the compressor 1100 and the rotary shaft of the turbine 1300 are directly connected. In the case of the large-scale gas turbine engine 1000, almost half of the output produced by the turbine 1300 is consumed to drive the compressor 1100. Accordingly, improving the efficiency of the compressor 1100 has a direct effect on improving the overall efficiency of the gas turbine engine 1000.

On the other hand, the combustor 1200 serves to mix the compressed air supplied from an outlet of the compressor 1100 with fuel and combust the mixture at constant pressure to produce hot combustion gases. The combustor 1200 mixes the introduced compressed air with fuel and combusts the air-fuel mixture to produce high-energy, high-temperature and high-pressure combustion gases, and increases the temperature of the combustion gases to the heat resistant limit at which the combustor and turbine parts can withstand heat through an isobaric combustion process.

A plurality of combustors 1200 may be arranged in a housing formed in the form of a cell, and each of the combustors include a burner containing a fuel injection nozzle, a combustor liner forming a combustion chamber, and a transition piece that is a connection between the combustor and the turbine.

The combustor 1200 is disposed on the downstream of the compressor 1100 such that a plurality of burners is disposed along an annular combustor casing 1210. Each burner is provided with several combustion nozzles 1230, and fuel injected from the combustion nozzles 1230 is mixed with the compressed air in an appropriate ratio suitable for combustion. The fuel injected from the fuel nozzles 1230 is mixed with the compressed air and then enters the combustion chamber 1240.

Since the combustor 1200 has the highest-temperature environment in the gas turbine engine 1000, the combustor requires appropriate cooling. Referring to FIGS. 1 and 2, a duct assembly connects the burner and the turbine 1300 so that a high temperature combustion gas flows therethrough. In other words, a duct assembly composed of a liner 1250 and the transition piece 1260, and a flow sleeve 1270 is provided such that the compressed air flows along an outer surface of the duct assembly to the combustion nozzle 1230. Thereby, the duct assembly heated by a high temperature combustion gas is properly cooled.

The combustor 1200 may accommodate a micro-mixer 1400 for proper mixing of fuel and air.

High-temperature and high-pressure combustion gas produced by the combustor 1200 is supplied to the turbine 1300 through the duct assembly.

The turbine 1300 may include a plurality of turbine blades rotated by the combustion gas combusted in the combustor 1200. In the turbine 1300, the combustion gas adiabatically expands and provides an impact and reaction force to turbine blades radially arranged on the rotary shaft of the turbine 1300 so that thermal energy of the combustion gas is converted into a mechanical energy in the rotation of the rotary shaft. A portion of the mechanical energy obtained from the turbine 1300 is used to compress air in the compressor, and the rest is used as an effective energy, for example, for driving a generator to produce power.

Hereinafter, a micro-mixer 1400 according to a first embodiment of the present disclosure will be described.

Figure 3:
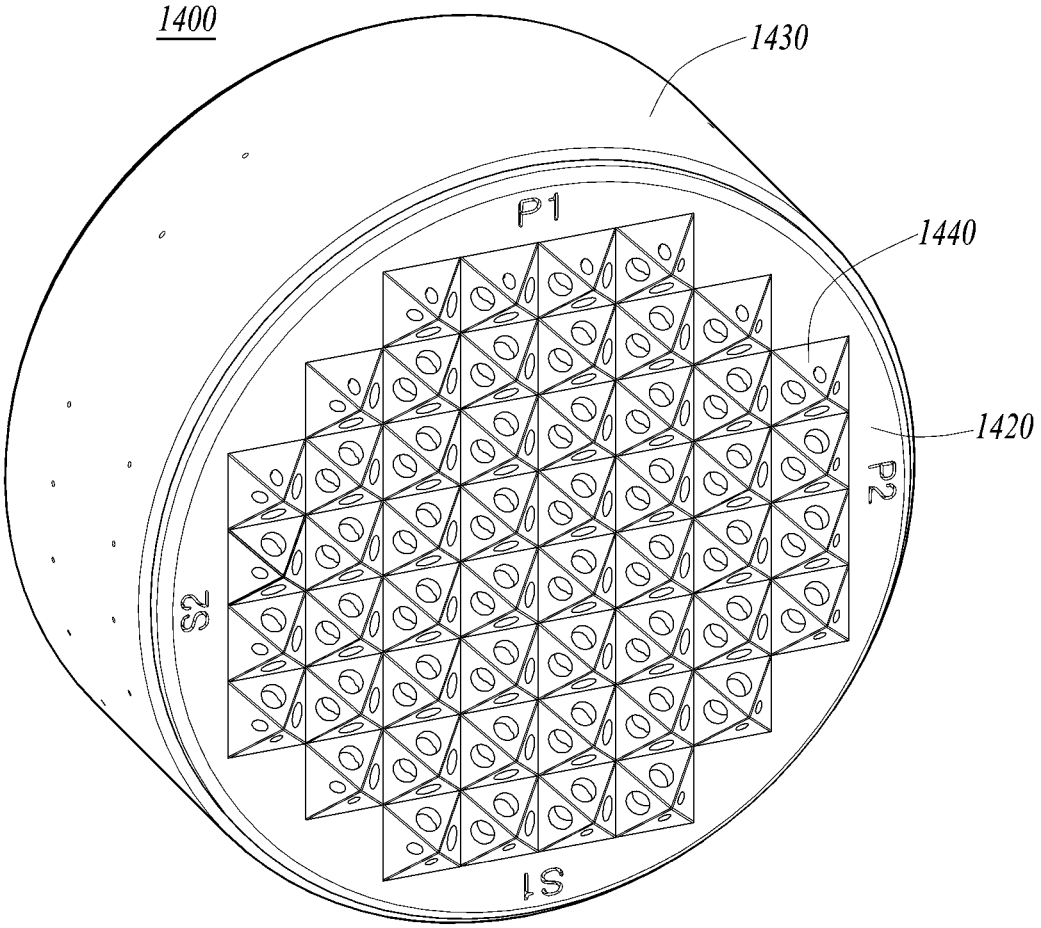
FIG. 3 is a perspective view illustrating a micro-mixer according to a first embodiment of the present disclosure.
Figure 4:
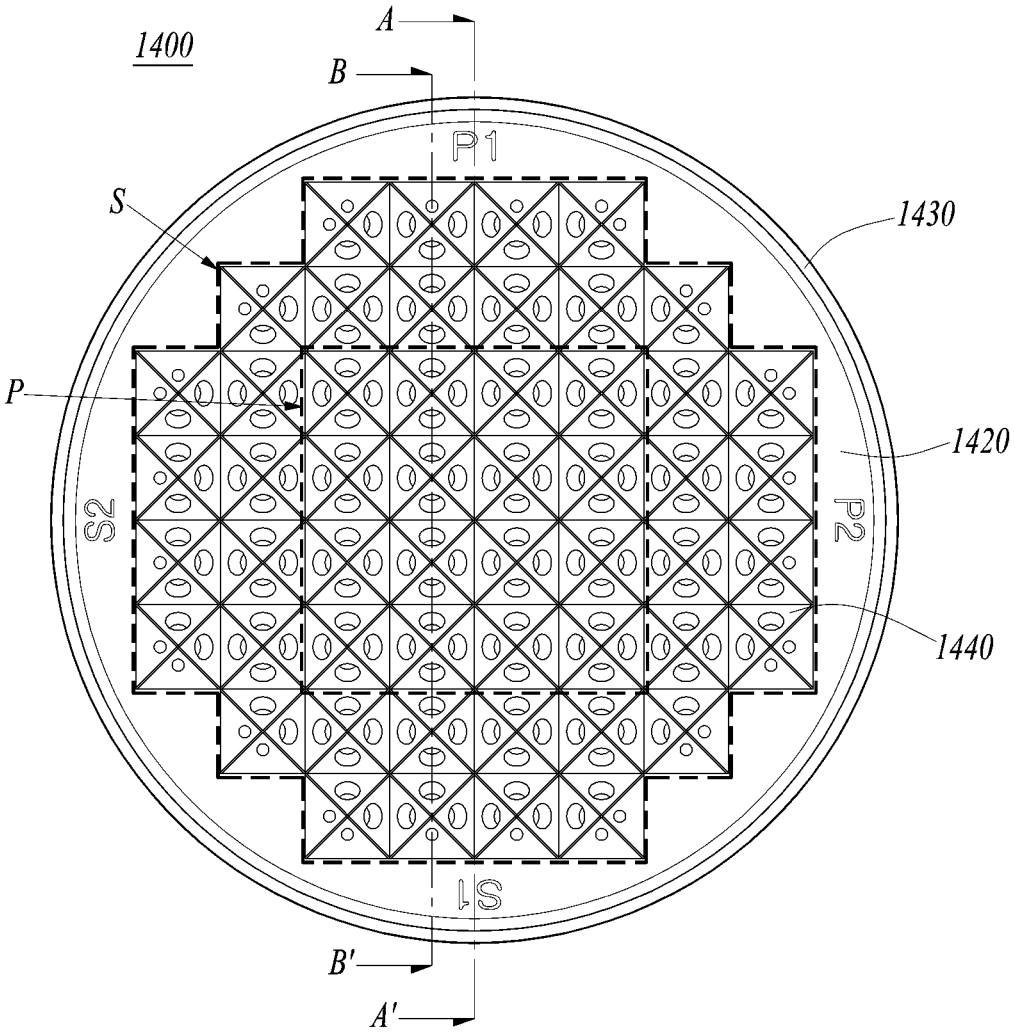
FIG. 4 is a front view illustrating the micro-mixer of FIG. 3.
Figure 5:
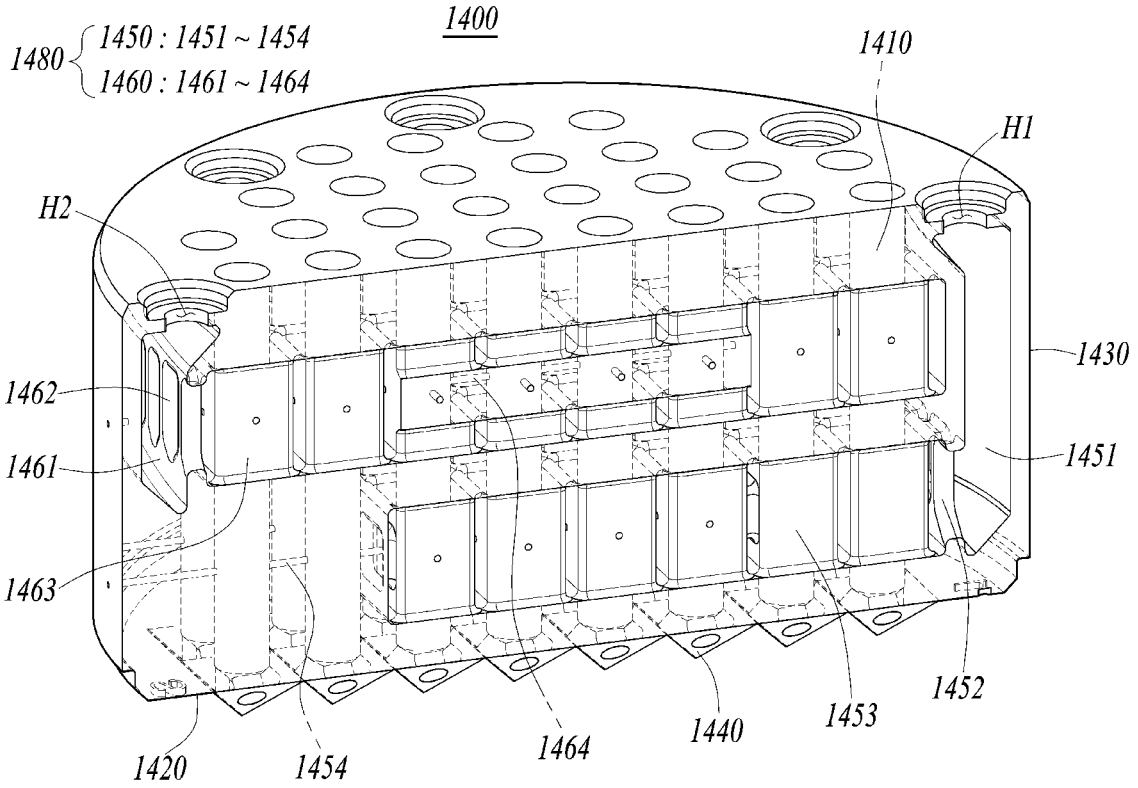
FIG. 5 is a cross-sectional view illustrating the interior of the micro-mixer of FIG. 3.
Figure 6:
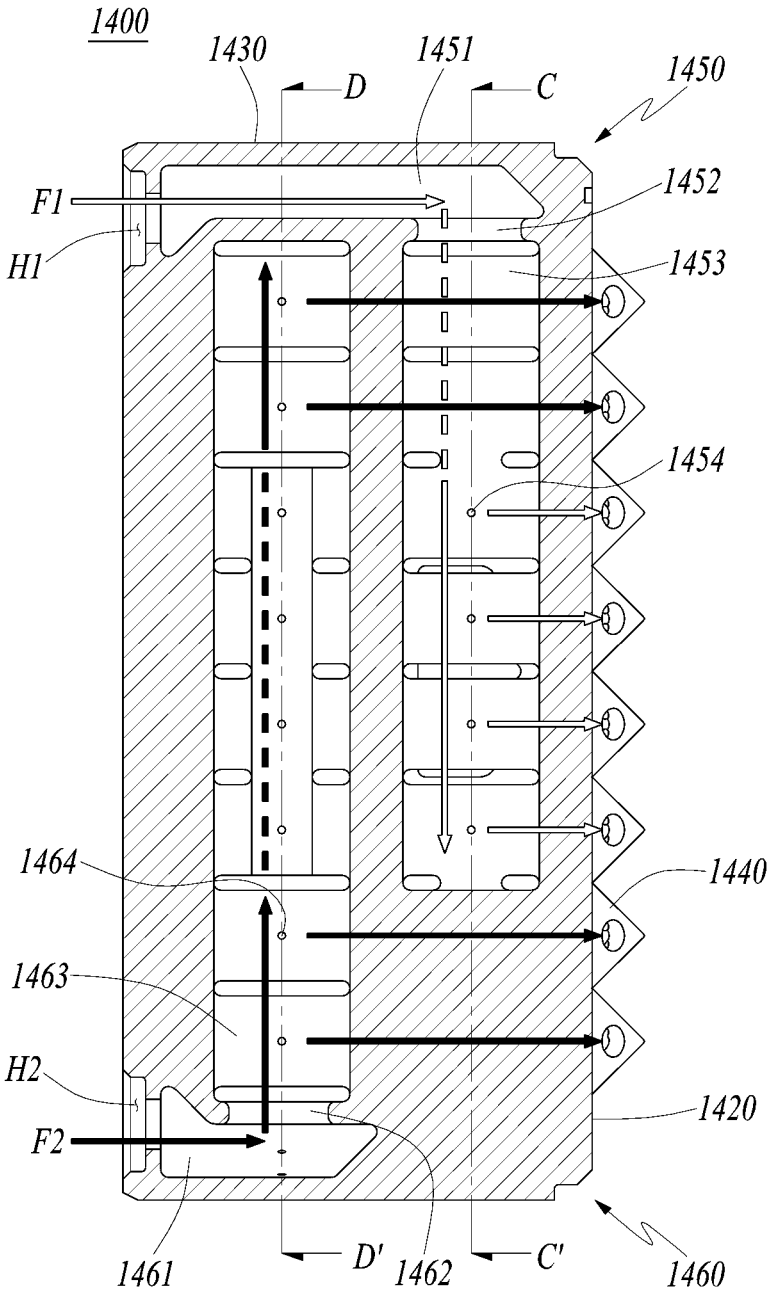
FIG. 6 is a cross-sectional view taken along line A-A' of FIG. 4.
Figure 7:
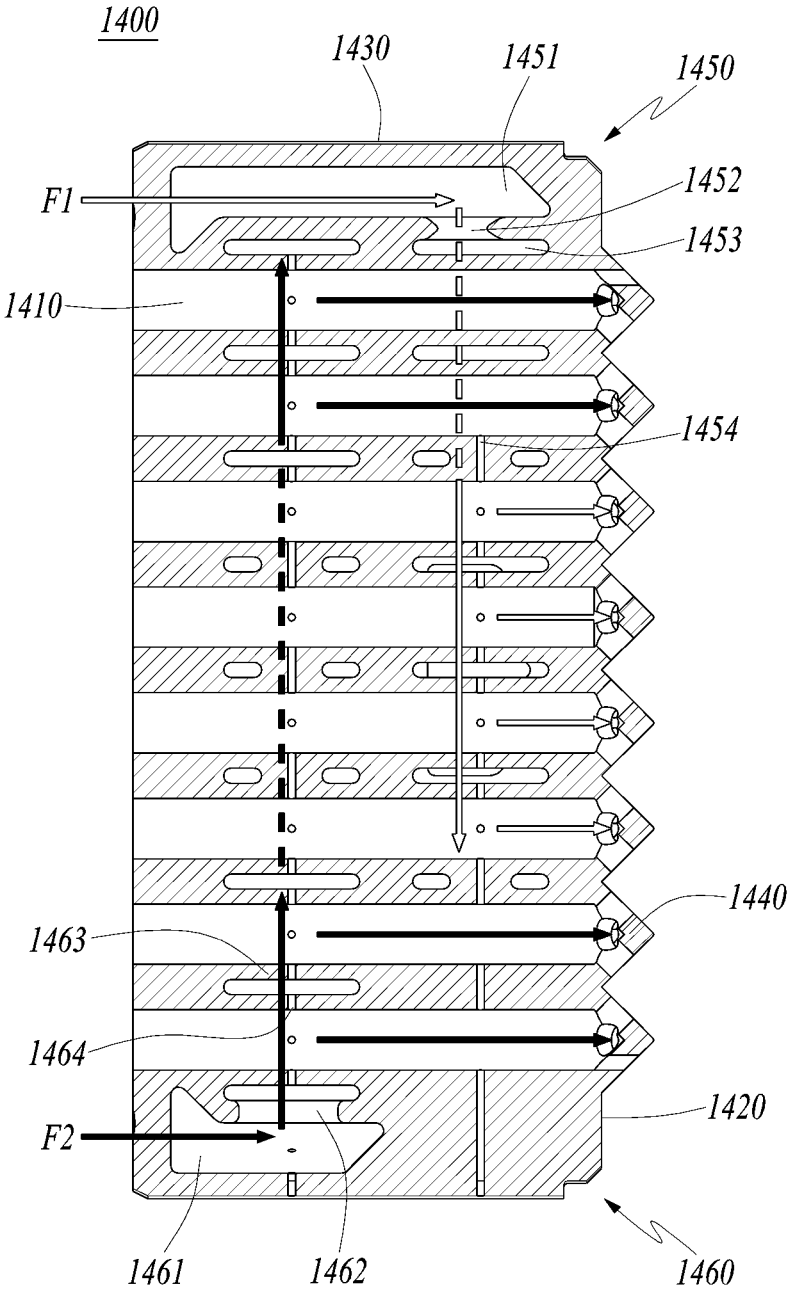
FIG. 7 is a cross-sectional view taken along line B-B' of FIG. 4.
Figure 8:
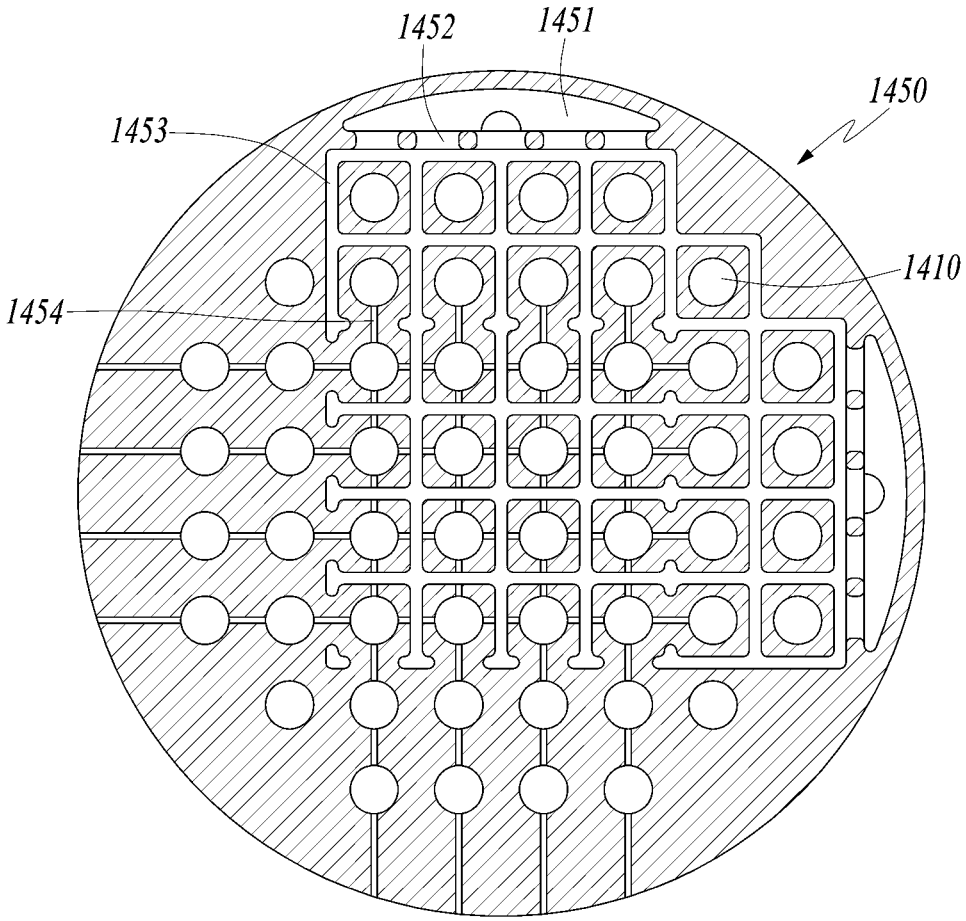
FIG. 8 is a cross-sectional view taken along line C-C' of FIG. 6.
Figure 9:
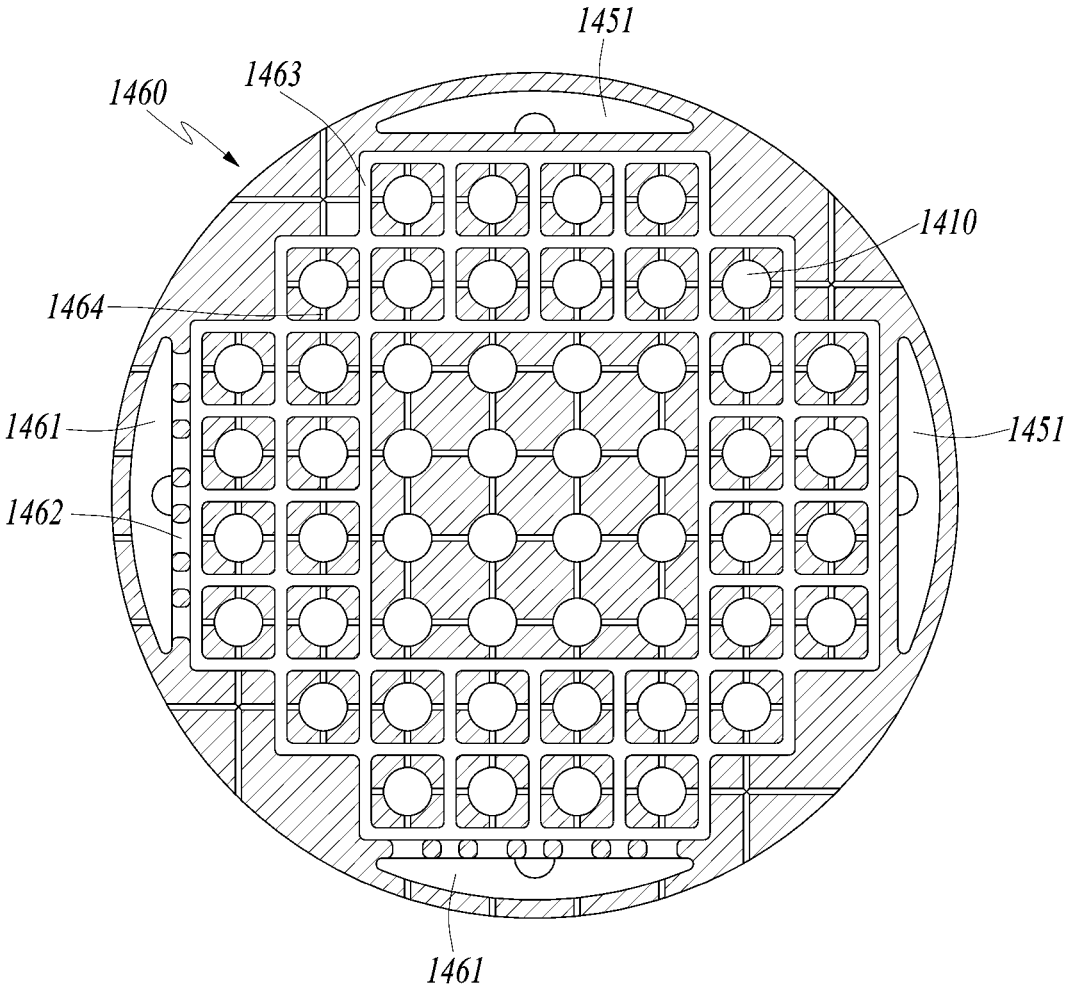
FIG. 9 is a cross-sectional view taken along line D-D' of FIG. 6.

FIG. 3 is a perspective view illustrating the micro-mixer according to the first embodiment of the present disclosure. FIG. 4 is a front view illustrating the micro-mixer of FIG. 3. FIG. 5 is a cross-sectional view illustrating the interior of the micro-mixer of FIG. 3. FIG. 6 is a cross-sectional view taken along line A-A' of FIG. 4. FIG. 7 is a cross-sectional view taken along line B-B' of FIG. 4. FIG. 8 is a cross-sectional view taken along line C-C' of FIG. 6. FIG. 9 is a cross-sectional view taken along line D-D' of FIG. 6.

Referring to FIGS. 3 to 9, the micro-mixer 1400 according to the first embodiment of the present disclosure may include fuel tubes 1410, a plate 1420, a casing 1430, fuel injection parts 1440, and a fuel supply 1480. The fuel supply 1480 may include a first fuel supply part 1450, and a second fuel supply part 1460. The micro-mixer 1400 facilitates mixing of compressed air and fuel supplied through a combustion nozzle 1230 to improve the mixing characteristics of the fuel and air, thereby reducing the amount of carbon monoxide and nitrogen oxide emissions.

Here, it can be understood by the ordinary skilled person in the art associated with this embodiment that other conventional components may be further included in the micro-mixer 1400 in addition to the components illustrated in FIGS. 3 to 9.

The fuel tube 1410 may be a passage through which air and fuel flow. A plurality of fuel tubes 1410 may be formed to form several small flames. The fuel tubes 1410 may be spaced apart from each other in the casing 1430, which will be described later, and may be formed parallel to each other. The diameter of the fuel tube 1410 may vary to finely inject fuel and air.

The plate 1420 may be a plate that is in direct contact with the combustion chamber 1240 of the casing 1430, which will be described later. Since the plate 1420 is exposed directly to flames generated by fuel combustion, the plate may be made of a heat resistant material having sufficient heat resistance to withstand high temperatures.

The casing 1430 may accommodate the plurality of fuel tubes 1410 therein. The casing 1430 may be provided on its front end with injection parts to be described below so that air and fuel flowing through the fuel tubes 1410 are injected into the combustion chamber 1240 through the injection parts. The casing 1430 may be provided on its rear end with a plurality of connection holes (not shown) to which the combustion nozzles 1230 are connected.

The casing 1430 may have a cylindrical body having an internal space in which the plurality of fuel tubes 1410 may be located. Since the casing 1430 comes into direct contact with flames generated by fuel combustion, the casing may be made of a material that has sufficient heat resistance to withstand high temperatures and sufficient durability to prevent deformation occurring due to combustion vibration. However, the shape and material of the casing 1430 are not limited thereto, and the casing may have various shapes and materials.

The injection parts 1440 may be formed on one side of the casing 1430 so as to be connected with the front ends of the fuel tubes 1410 so that air and fuel are injected therethrough. The injection part 1440 may protrude from the front end of fuel tube 1410 in a pyramidal shape. The injection part 1440 may include an inclined injection hole formed obliquely in the extension direction of the fuel tube 1410 on any one side of the pyramidal shape. The extension direction of the fuel tube 1410 may be a same direction with an axial direction of the fuel tube 1410 along the flow of fuel therein.

An angle between the extension direction of the fuel tube 1410 and the extension direction of the inclined injection hole may vary depending on dynamic characteristics for reducing combustion vibration. The fuel injected through or discharged from the inclined injection hole may collide with fuel injected through or discharged from a surrounding inclined injection hole of an adjacent injection part to form a recirculation area so that air and fuel are mixed in the recirculation area.

According to an embodiment, the fuel supply 1480 may include a first fuel supply part 1450 and a second fuel supply part 1460. According to an embodiment, the fuel supply 1480 may be composed of a plurality of fuel supply parts to supply fuel to the fuel tubes 1410. The first fuel supply part 1450 and the second fuel supply part 1460 may independently control a supply of fuel. The supply of fuel may be independently or differently controlled, from one fuel supply part to another, by, for example, supplying a relatively high equivalent ratio of fuel to the first fuel supply part 1450 and supplying a relatively low equivalent ratio of fuel to the second fuel supply part 1460.

According to an embodiment, the fuel supply 1480 may differently control a distribution ratio of fuel distributed to the first fuel supply part 1450 and the second fuel supply part 1460 according to the operating section or the operation stages of the combustor 1200. For example, the initial combustion stage of the combustor 1200, a high equivalent ratio of fuel may be provided through the first fuel supply part 1450 for start-up ignition to enable ignition to occur even in a low-temperature environment of the combustor 1200. Thereafter, a relatively low equivalent ratio of fuel may be provided through the second fuel supply part 1460 so that the combustor 1200 continues to operate.

According to an embodiment, the fuel supply 1480 may differently control a distribution ratio of fuel distributed to the first fuel supply part 1450 and the second fuel supply part 1460 for operational stability of the combustor 1200. For example, when a combustion reaction occurs in a fuel-lean state in which the flame temperature is low, it is possible to prevent the flame temperature from being excessively lowered by supplying a high equivalent ratio of fuel through the first fuel supply part 1450.

In addition, when the flame temperature is high, it is possible to prevent the flame temperature from being excessively increased by supplying a low equivalent ratio of fuel through the second fuel supply part 1460. As such, it is possible to maintain proper flame temperature and flame stability by dividing the fuel supply into the first fuel supply part 1450 and the second fuel supply part 1460 and independently controlling the supply of fuel. That is, it is possible to solve problems of unburned hydrocarbon (UHC) or carbon monoxide due to low flame temperature, combustion vibration due to flame instability, and nitrogen oxide generation due to high flame temperature.

According to an embodiment, the first fuel supply part 1450 may include a first fuel container 1451, a first fuel inlet 1452, a first fuel distribution module 1453, and a first fuel injection module 1454. The first fuel supply part 1450 may inject fuel into the fuel tubes 1410 located in a first region P. Here, the first region P may be located at a central portion of the fuel tubes 1410 (see FIG. 4).

The first fuel supply part 1450 may control a supply of fuel independently of the second fuel supply part 1460. According to an embodiment, the first fuel supply part 1450 may serve as a pilot burner supplying a high equivalent ratio of fuel for initial start-up of the combustor 1200.

According to an embodiment, the first fuel supply part 1450 and the second fuel supply part 1460 may be disposed in a layered structure such that the first fuel supply part 1450 is disposed closer to the injection parts 1440 than the second fuel supply part 1460. Since the first fuel supply part 1450 and the second fuel supply part 1460 are arranged in a layered structure, even if there is no separate device for mixing air and fuel, an equivalent ratio of air and fuel may be controlled by using different mixing distances to the injection part 1440. In other words, the equivalent ratio may be different and may be controlled depending on a distance from a position where fuel is injected into the fuel tube 1410 from a fuel supply part included in the fuel supply (e.g., the first supply part 1450 or the second fuel supply part 1460) to a position where the fuel is discharged through the injection parts 1440. Such distance may be referred to as a mixing travel distance. The mixing travel distance for the first fuel supply part 1450 may be shorter than the mixing travel distance for the second fuel supply part 1460. Specifically, supposed that the first fuel supply part 1450 injects fuel into the fuel tubes 1410 located in the first region P, since the first fuel supply part 1450 is disposed closer to the injection part 1440 than the second fuel supply part 1460, fuel to be injected into the fuel tubes 1410 in the first region P may be discharged through the injection parts 1440 without being sufficiently mixed with the compressed air in the fuel tube 1410. Accordingly, the first fuel supply part 1450 may supply a high equivalent ratio of fuel to the combustion chamber 1240.

According to an embodiment, the first fuel container 1451 may receive fuel through a first fuel supply hole H1. The first fuel container 1451 may receive the fuel through the first fuel supply hole H1 connected with the combustion nozzle 1230 and then supply the fuel to the first fuel distribution module 1453 through the first fuel inlet 1452 described below.

The first fuel container 1451 may have a box body having an internal space to temporarily accommodate fuel before delivered to the first fuel distribution module 1453. The first fuel container 1451 may be made of a material that is rigid enough not to be damaged even when fuel is supplied at a high pressure. However, the shape and material of the first fuel container 1451 are not limited thereto, and the first fuel container 1451 may have various shapes and materials.

The first fuel inlet 1452 may be formed in the first fuel container 1451. The first fuel inlet 1452 may have a tubular body formed between the first fuel container 1451 and the first fuel distribution module 1453.

The plurality of first fuel inlets 1452 may be spaced in parallel and apart at regular intervals from each other to deliver fuel evenly to the first fuel distribution module 1453 (see FIG. 8). The diameter of the first fuel inlet 1452 may vary depending on the pressure and delivery speed of the fuel being delivered.

The first fuel inlet 1452 may be made of a material having sufficient rigidity so as not to be destroyed even if the fuel flows at a high pressure. However, the shape and material of the first fuel inlet 1452 are not limited thereto, and the first fuel inlet may have any shape and material so long as they can serve as a passage through which fuel is delivered to the first fuel distribution module 1453.

The first fuel distribution module 1453 may be connected to the first fuel inlet 1452 to distribute fuel introduced through the first fuel inlet 1452 to the fuel tubes 1410 in the first region P. The first fuel distribution module 1453 may have a thin rectangular box body having a space through which fuel can flow and extending across the fuel tubes 1410 (see FIGS. 5 and 8). When viewed from an axial direction of the micro-mixer 1400, a cross-section of the first fuel distribution module 1453 may have a thin rectangular shape. (See FIGS. 5 and 8).

For each of the first fuel distribution module 1453, the distance between the first fuel distribution module 1453 and the nearest fuel tube 1410 may be the same. Thereby, the first fuel distribution module 1453 may equally distribute fuel to the fuel tubes 1410 located in the first region P, since the distance from each of the first fuel distribution module 1453 to the nearest fuel tube 1410 is equally maintained.

The first fuel distribution module 1453 may be made of a material having sufficient rigidity so as not to be destroyed even when fuel is delivered at a high pressure. However, the shape and material of the first fuel distribution module 1453 are not limited thereto, and may be changed within a conceivable range by those skilled in the art.

The first fuel injection module 1454 may connect the first fuel distribution module 1453 and the fuel tubes 1410 in the first region P to inject fuel from the first fuel distribution module 1453 into the fuel tubes 1410. The first fuel injection module 1454 may extend through the fuel tubes 1410 in a direction transverse to the extension direction of the fuel tubes 1410. The first fuel injection module 1454 may have a tubular body having an internal space through which fuel can flow. The first fuel injection module 1454 may be connected to the first fuel distribution modules 1453 respectively surrounding the fuel tubes 1410 (see FIGS. 5 and 8).

A first flow of fuel F1 supplied to the first fuel container 1451 of the first fuel supply part 1450 may flow to the fuel tubes 1410 located in the first region P through the first fuel inlet 1452, the first fuel distribution module 1453, and the first fuel injection module 1454 (see FIGS. 6 and 7). Fuel supplied to the fuel tubes 1410 in the first region P may be injected into the combustion chamber 1240.

According to an embodiment, the second fuel supply part 1460 may include a second fuel container 1461, a second fuel inlet 1462, a second fuel distribution module 1463, and a second fuel injection module 1464. The second fuel supply part 1460 may inject fuel into the fuel tubes 1410 located in a second region S. The second region S may be a region of covered by the injection parts 1440 excluding the first region P. Here, the second region S may be located around the central portion of the fuel tubes 1410 (see FIG. 4).

The second fuel supply part 1460 may control a supply of fuel independently of the first fuel supply part 1450. According to an embodiment, the second fuel supply part 1460 may serve as a main burner supplying a relatively low equivalent ratio of fuel for the main operation of the combustor 1200.

According to an embodiment, the first fuel supply part 1450 and the second fuel supply part 1460 may be disposed in a layered structure such that the second fuel supply part 1460 is disposed away from the injection parts 1440 than the first fuel supply part 1450. Since the first fuel supply part 1450 and the second fuel supply part 1460 are arranged in a layered structure, even if there is no separate device for mixing air and fuel, an equivalent ratio of air and fuel may be controlled by using different mixing distances to the injection part 1440.

Specifically, supposed that the second fuel supply part 1460 injects fuel into the fuel tubes 1410 located in the second region, since the second fuel supply part 1460 is disposed away from the injection part 1440 than the first fuel supply part 1450, fuel to be injected into the fuel tubes 1410 in the second region S may be discharged through the injection parts 1440 in a state of being sufficiently mixed with the compressed air in the fuel tube 1410. Accordingly, the second fuel supply part 1460 may supply a relatively low equivalent ratio of fuel that is evenly mixed to the combustion chamber 1240.

According to an embodiment, the second fuel container 1461 may receive fuel through a second fuel supply hole H2. The second fuel container 1461 may receive the fuel through the second fuel supply hole H2 connected with the combustion nozzle 1230 and then supply the fuel to the second fuel distribution module 1463 through the second fuel inlet 1462 described below.

The second fuel container 1461 may have a box body having an internal space to temporarily accommodate fuel before delivered to the second fuel distribution module 1463. The second fuel container 1461 may be made of a material that is rigid enough not to be damaged even when fuel is supplied at a high pressure. However, the shape and material of the second fuel container 1461 are not limited thereto, and the second fuel container 1461 may have various shapes and materials.

The second fuel inlet 1462 may be formed in the second fuel container 1461. The second fuel inlet 1462 may have a tubular body formed between the second fuel container 1461 and the second fuel distribution module 1463.

The plurality of second fuel inlets 1462 may be spaced in parallel and apart at regular intervals from each other to deliver fuel evenly to the second fuel distribution module 1463 (see FIG. 9). The diameter of the second fuel inlet 1462 may vary depending on the pressure and delivery speed of the fuel being delivered.

The second fuel inlet 1462 may be made of a material having sufficient rigidity so as not to be destroyed even if the fuel flows at a high pressure. However, the shape and material of the second fuel inlet 1462 are not limited thereto, and the second fuel inlet may have any shape and material so long as they can serve as a passage through which fuel is delivered to the second fuel distribution module 1463.

The second fuel distribution module 1463 may be connected to the second fuel inlet 1462 to distribute fuel introduced through the second fuel inlet 1462 to the fuel tubes 1410 in the second region S. The second fuel distribution module 1463 may have a thin rectangular box body having a space through which fuel can flow and extending across the fuel tubes 1410 (see FIGS. 5 and 9). When viewed from an axial direction of the micro-mixer 1400, a cross-section of the second fuel distribution module 1463 may have a thin rectangular shape. (See FIGS. 5 and 9).

For each of the first fuel distribution module 1453, the distance between the second fuel distribution module 1463 and the nearest fuel tube 1410 may be the same. Thereby, the second fuel distribution module 1463 may equally distribute fuel to the fuel tubes 1410 located in the second region S, since the distance from each of the second fuel distribution module 1463 to the nearest fuel tube 1410 is equally maintained.

The second fuel distribution module 1463 may be made of a material having sufficient rigidity so as not to be destroyed even when fuel is delivered at a high pressure. However, the shape and material of the second fuel distribution module 1463 are not limited thereto, and may be changed within a conceivable range by those skilled in the art.

The second fuel injection module 1464 may connect the second fuel distribution module 1463 and the fuel tubes 1410 in the second region S to inject fuel from the second fuel distribution module 1463 into the fuel tubes 1410. The second fuel injection module 1464 may extend through the fuel tubes 1410 in a direction transverse to the extension direction of the fuel tubes 1410. The second fuel injection module 1464 may have a tubular body having an internal space through which fuel can flow. The second fuel injection module 1464 may be connected to the second fuel distribution modules 1463 respectively surrounding the fuel tubes 1410 (see FIGS. 5 and 9).

A second flow of fuel F2 supplied to the second fuel container 1461 of the second fuel supply part 1460 may flow to the fuel tubes 1410 located in the second region S through the second fuel inlet 1462, the second fuel distribution module 1463, and the second fuel injection module 1464 (see FIGS. 6 and 7). Fuel supplied to the fuel tubes 1410 in the second region S may be injected into the combustion chamber 1240.

Hereinafter, a micro-mixer 1400 according to a second embodiment of the present disclosure will be described.

Figure 10:
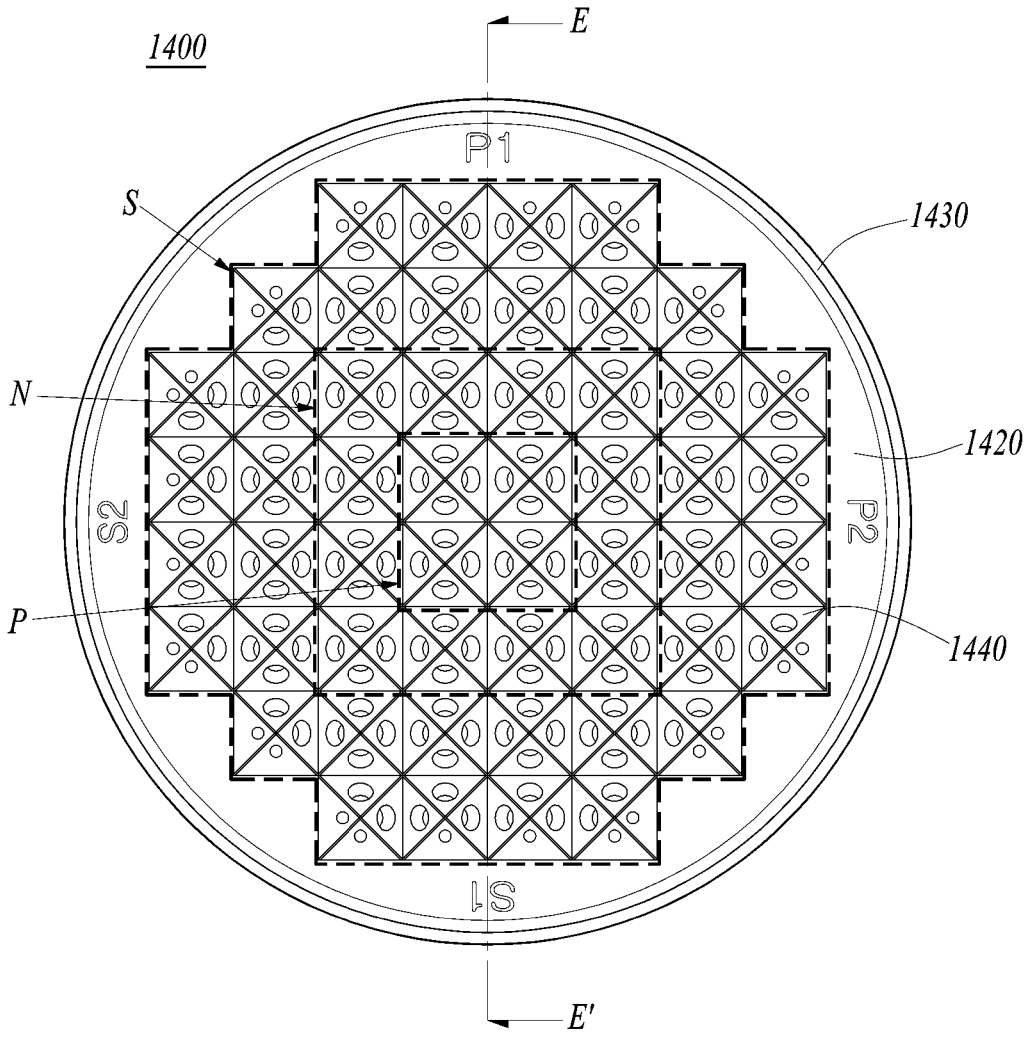
FIG. 10 is a front view illustrating a micro-mixer according to a second embodiment of the present disclosure.
Figure 11:
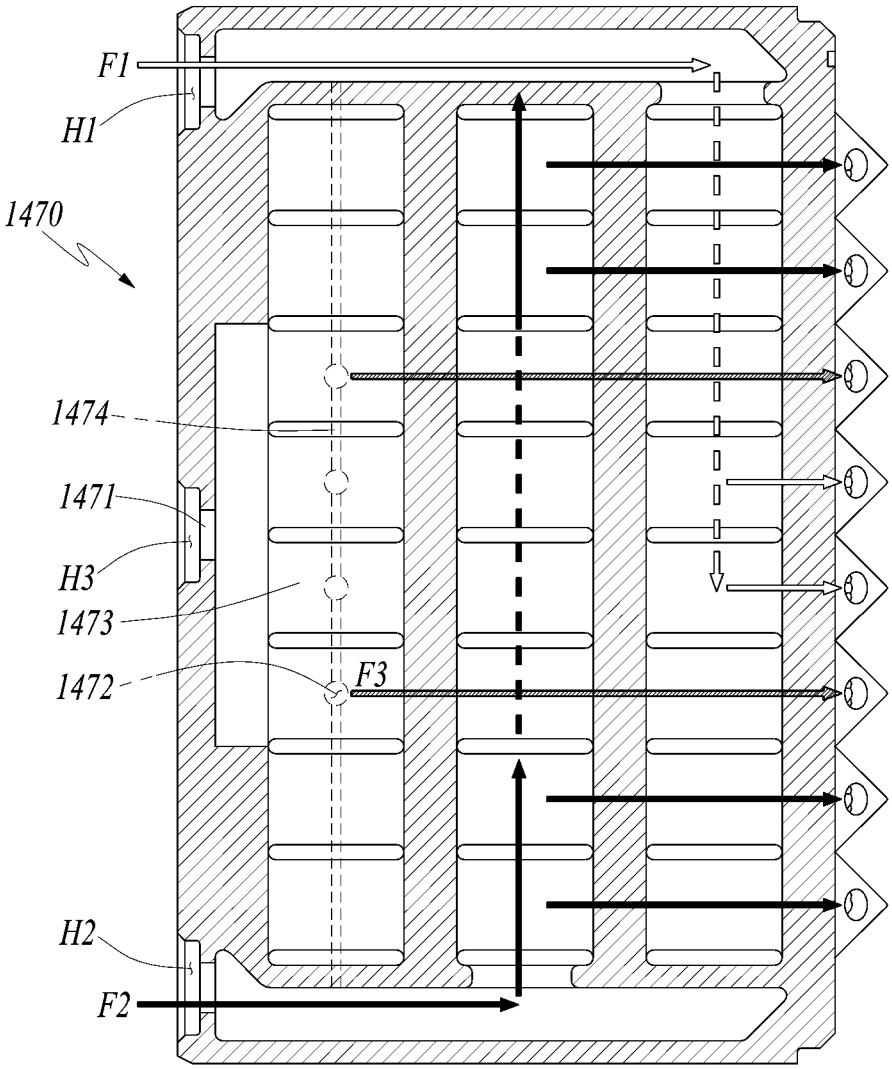
FIG. 11 is a cross-sectional view taken along line E-E' of FIG. 10.

FIG. 10 is a front view illustrating a micro-mixer according to a second embodiment of the present disclosure, and FIG. 11 is a cross-sectional view taken along line E-E' of FIG. 10.

Referring to FIGS. 10 and 11, the micro-mixer 1400 according to the second embodiment has the same structure as that of the micro-mixer 1400 according to the first embodiment, except that the micro-mixer according to the second embodiment further includes a third fuel supply part 1470, so a repeated description of the same structure will be omitted.

According to this embodiment, the fuel supply 1480 may include a first fuel supply part 1450, a second fuel supply part 1460, and a third fuel supply part 1470. According to an embodiment, the fuel supply 1480 may be composed of a plurality of fuel supply parts to supply fuel to the fuel tubes 1410. The first fuel supply part 1450, the second fuel supply part 1460, and the third fuel supply part 1470 may independently or differently control a supply of fuel from one another, by, for example, supplying different equivalent ratio of fuels to the first fuel supply part 1450, the second fuel supply part 1460, and the third fuel supply part 1470.

According to an embodiment, the fuel supply 1480 may differently control a distribution ratio of fuel distributed to the first fuel supply part 1450, the second fuel supply part 1460, and the third fuel supply part 1470 according to the operating section or the operation stages of the combustor 1200. In this way, by controlling the fuel distribution ratio, it is possible to control an equivalent ratio or a distribution ratio of injected fuel more precisely than in the case where there is no third fuel supply part 1470. Accordingly, it is possible to control flame temperature, flame stability, and combustion vibration during combustion more stably.

According to an embodiment, the third fuel supply part 1470 may include a third fuel container 1471, a third fuel inlet 1472, a third fuel distribution module 1473, and a third fuel injection module 1474. The third fuel supply part 1470 may inject fuel into the fuel tubes 1410 located in a third region N. Here, the third region N may be located between the first region P and the second region S (see FIG. 10). Components and structures of the third fuel supply part 1470 may be the same as those of the first fuel supply part 1450.

The first fuel supply part 1450, the second fuel supply part 1460, and the third fuel supply part 1470 may independently control a supply of fuel.

According an embodiment, the first fuel supply part 1450, the second fuel supply part 1460, and the third fuel supply part 1470 may be disposed in a layered structure such that the second fuel supply part 1460 is disposed away from the injection parts 1440 than the first fuel supply part 1450 and the third fuel supply part 1470 is disposed between the first fuel supply part 1450 and the second fuel supply part 1460.

Since the first fuel supply part 1450, the second fuel supply part 1460, and the third fuel supply part 1470 may be disposed in a layered structure, even if there is no separate device for mixing air and fuel, an equivalent ratio of air and fuel may be controlled by using a mixing distance to the injection part 1440.

A third flow of fuel F3 supplied to the third fuel container 1471 through a third fuel supply hole H3 may flow to the fuel tubes 1410 located in the third region N through the third fuel inlet 1472, the third fuel distribution module 1473, and the third fuel injection module 1474 (see FIG. 11). Fuel supplied to the fuel tubes 1410 in the third region N may be injected into the combustion chamber 1240.

While the embodiments of the present disclosure have been described, it will be apparent to those skilled in the art that various modifications and variations can be made in the present disclosure through addition, change, omission, or substitution of components without departing from the spirit of the invention as set forth in the appended claims, and such modifications and changes may also be included within the scope of the present disclosure. Also, it is noted that any one feature of an embodiment of the present disclosure described in the specification may be applied to another embodiment of the present disclosure.

The invention claimed is:

1. A micro-mixer comprising:

a plurality of fuel tubes through which air and fuel flow and extend in an axial direction;

a casing accommodating the plurality of fuel tubes therein;

an injection part formed as a pyramidal protrusion on one side of the casing and connected to a front end of a fuel tube of the plurality of fuel tubes to inject the air and the fuel; and a fuel supply divided into a plurality of fuel supply parts to supply the fuel to the plurality of fuel tubes, wherein each of the plurality of fuel supply parts comprises a plurality of fuel injection modules, with each of the plurality of fuel injection modules having a tubular body with an internal space through which the fuel flows and extending in a straight line through a direction substantially perpendicular to the axial direction while passing through at least two of the plurality of fuel tubes at a predetermined distance from an upstream end of the least two of the plurality of fuel tubes, wherein the fuel supply includes:

a first fuel supply part of the plurality of fuel supply parts configured to inject the fuel into first fuel tubes of the plurality of fuel tubes located at a central portion of the plurality of fuel tubes; and a second fuel supply part of the plurality of fuel supply parts configured to inject the fuel into second fuel tubes of the plurality of fuel tubes located at a peripheral portion around the central portion of the plurality of fuel tubes, wherein the second fuel supply part is configured to receive the fuel from a first end of the peripheral portion and to direct a flow of the fuel from the first end to its opposite end within the peripheral portion in the direction substantially perpendicular to the axial direction, while supplying the fuel to the second fuel tubes through the plurality of fuel injection modules and not supplying the fuel to the first fuel tubes.

2. The micro-mixer according to claim 1, wherein the first fuel supply part and the second fuel supply part are disposed in a layered structure, and the first fuel supply part is disposed closer to the injection part than the second fuel supply part.

3. The micro-mixer according to claim 1, wherein the first fuel supply part and the second fuel supply part independently control a supply of fuel.

4. The micro-mixer according to claim 1, wherein the first fuel supply part includes:

a first fuel container receiving the fuel through a first fuel supply hole;

a first fuel inlet formed in the first fuel container;

a first fuel distribution module connected to the first fuel inlet to distribute the fuel introduced through the first fuel inlet to the first fuel tubes; and a first fuel injection module of the plurality of fuel injection modules connecting the first fuel distribution module and the first fuel tubes to inject the fuel to the plurality of fuel tubes.

5. The micro-mixer according to claim 4, wherein the second fuel supply part includes:

a second fuel container receiving the fuel through a second fuel supply hole;

a second fuel inlet formed in the second fuel container;

a second fuel distribution module connected to the second inlet to distribute the fuel introduced through the second fuel inlet to the second fuel tubes; and a second fuel injection module of the plurality of fuel injection modules connecting the second fuel distribution module and the second fuel tubes to inject the fuel to the plurality of fuel tubes.

6. The micro-mixer according to claim 5, wherein the first fuel distribution module and the second fuel distribution module have a same distance to the closest fuel tubes thereto.

7. The micro-mixer according to claim 1, wherein the fuel supply further includes a third fuel supply part configured to inject the fuel into the fuel tubes located in a region.

8. The micro-mixer according to claim 7, wherein a first region is located at the central portion of the fuel tubes, a second region is located at the peripheral portion around the central portion of the fuel tubes, and the region is a third region, and the third region is located between the first region and the second region.

9. The micro-mixer according to claim 1, wherein the first fuel supply part is configured to receive the fuel from a second end of the peripheral portion and to direct the flow of the fuel from the second end toward its opposite end within the peripheral portion, while supplying the fuel to the first fuel tubes and not supplying the fuel to the second fuel tubes.

10. A gas turbine comprising:

a compressor configured to compress air introduced from the outside;

a combustor having a micro-mixer and configured to mix the compressed air compressed in the compressor and fuel and combust an air-fuel mixture, and a turbine including a plurality of turbine blades to be rotated by combustion gases combusted in the combustor, wherein the micro-mixer comprises:

a plurality of fuel tubes through which the air and the fuel flow and extend in an axial direction;

a casing accommodating the plurality of fuel tubes therein;

an injection part formed as a pyramidal protrusion on one side of the casing and connected to a front end of a fuel tube of the plurality of fuel tubes to inject the air and the fuel; and a fuel supply divided into a plurality of fuel supply parts to supply the fuel to the plurality of fuel tubes, wherein each of the plurality of fuel supply parts comprises a plurality of fuel injection modules, with each of the plurality of fuel injection modules having a tubular body with an internal space through which the fuel flows and extending in a straight line through a direction substantially perpendicular to the axial direction while passing through at least two of the plurality of fuel tubes at a predetermined distance from an upstream end of the least two of the plurality of fuel tubes, wherein the fuel supply includes:

a first fuel supply part of the plurality of fuel supply parts configured to inject the fuel into first fuel tubes of the plurality of fuel tubes located at a central portion of the plurality of fuel tubes; and a second fuel supply part of the plurality of fuel supply parts configured to inject the fuel into second fuel tubes of the plurality of fuel tubes located at a peripheral portion around the central portion of the plurality of fuel tubes, wherein the second fuel supply part is configured to receive the fuel from a first end of the peripheral portion and to direct a flow of the fuel from the first end to its opposite end within the peripheral portion in the direction substantially perpendicular to the axial direction, while supplying the fuel to the second fuel tubes through the plurality of fuel injection modules and not supplying the fuel to the first fuel tubes.

11. The gas turbine according to claim 10, wherein the first fuel supply part and the second fuel supply part are disposed in a layered structure, and the first fuel supply part is disposed closer to the injection part than the second fuel supply part.

12. The gas turbine according to claim 10, wherein the first fuel supply part and the second fuel supply part independently control a supply of fuel.

13. The gas turbine according to claim 10, wherein the first fuel supply part includes:

a first fuel container receiving the fuel through a first fuel supply hole;

a first fuel inlet formed in the first fuel container;

a first fuel distribution module connected to the first fuel inlet to distribute the fuel introduced through the first fuel inlet to the first fuel tubes; and a first fuel injection module of the plurality of fuel injection modules connecting the first fuel distribution module and the first fuel tubes in the first region to inject the fuel to the plurality of fuel tubes.

14. The gas turbine according to claim 13, wherein the second fuel supply part includes:

a second fuel container receiving the fuel through a second fuel supply hole;

a second fuel inlet formed in the second fuel container;

a second fuel distribution module connected to the second inlet to distribute the fuel introduced through the second fuel inlet to the second fuel tubes; and a second fuel injection module of the plurality of fuel injection modules connecting the second fuel distribution module and the second fuel tubes to inject the fuel to the plurality of fuel tubes.

15. The gas turbine according to claim 14, wherein the first fuel distribution module and the second fuel distribution module have a same distance to the closest fuel tubes thereto.

16. The gas turbine according to claim 10, wherein the fuel supply further includes a third fuel supply part configured to inject the fuel into the fuel tubes corresponding to a region.

17. The gas turbine according to claim 16, wherein a first region is located at the central portion of the fuel tubes, a second region is located at the peripheral portion around the central portion of the fuel tubes, and the region is a third region, and the third region is located between the first region and the second region.

18. The gas turbine according to claim 10, wherein the first fuel supply part is configured to receive the fuel from a second end of the peripheral portion and to direct the flow of the fuel from the second end toward its opposite end within the peripheral portion, while supplying the fuel to the first fuel tubes and not supplying the fuel to the second fuel tubes.

* * * * *